US008708771B1

(12) United States Patent
De Rosa

(10) Patent No.: US 8,708,771 B1
(45) Date of Patent: Apr. 29, 2014

(54) BRASSIERE WITH INSERT HOLDING POCKET

(71) Applicant: Angelina De Rosa, Clarksville, MD (US)

(72) Inventor: Angelina De Rosa, Clarksville, MD (US)

( * ) Notice: Subject to any disclaimer, the term of this patent is extended or adjusted under 35 U.S.C. 154(b) by 41 days.

(21) Appl. No.: 13/645,994

(22) Filed: Oct. 5, 2012

(51) Int. Cl.
*A41C 3/00* (2006.01)

(52) U.S. Cl.
USPC ..... 450/36; 450/57

(58) Field of Classification Search
USPC ..... 450/54–58, 36–38; 2/267, 268
See application file for complete search history.

(56) References Cited

U.S. PATENT DOCUMENTS

| | | | | | |
|---|---|---|---|---|---|
| 623,413 | A | | 4/1899 | Murray | |
| 1,136,727 | A | | 4/1915 | Smith | |
| 1,664,214 | A | | 3/1928 | Hudson | |
| 1,989,382 | A | * | 1/1935 | Schnaittacher | 604/346 |
| 2,121,088 | A | | 6/1938 | Rue | |
| 2,502,524 | A | | 4/1950 | Keller | |
| 2,522,010 | A | | 9/1950 | Woodruff | |
| 2,615,172 | A | | 10/1952 | Donegan | |
| 2,627,606 | A | | 2/1953 | Grandis | |
| 2,679,048 | A | | 5/1954 | Alberts | |
| 2,698,940 | A | * | 1/1955 | Dombek | 450/41 |
| 3,115,141 | A | | 12/1963 | Means et al. | |
| 3,701,168 | A | | 10/1972 | Balow | |
| 3,763,865 | A | * | 10/1973 | DeFru | 450/41 |
| 4,222,387 | A | | 9/1980 | Tetu | |
| 4,335,728 | A | | 6/1982 | Fildan | |
| 5,679,052 | A | | 10/1997 | Rucki | |
| 5,839,942 | A | | 11/1998 | Miller | |
| 5,873,768 | A | | 2/1999 | Fleischman-Ament et al. | |
| 6,074,273 | A | | 6/2000 | Turner et al. | |
| 6,241,715 | B1 | | 6/2001 | Houser et al. | |
| 6,257,952 | B1 | | 7/2001 | Valentin | |
| 6,319,092 | B1 | | 11/2001 | Leyhe et al. | |
| 6,346,027 | B1 | | 2/2002 | Merkovsky | |
| 6,361,398 | B1 | | 3/2002 | Knapp | |
| 6,364,739 | B1 | | 4/2002 | Dutka et al. | |
| 6,394,879 | B1 | | 5/2002 | Paige | |
| 6,464,717 | B1 | | 10/2002 | Smith et al. | |
| 6,645,041 | B2 | | 11/2003 | Sorensen | |
| 6,659,841 | B2 | * | 12/2003 | Raimondo | 450/36 |
| 6,786,798 | B1 | | 9/2004 | Gendel | |
| 6,821,185 | B1 | | 11/2004 | Francis | |
| 6,827,628 | B2 | | 12/2004 | Kaye et al. | |
| 6,855,029 | B2 | | 2/2005 | Rothman | |
| 7,048,606 | B1 | | 5/2006 | Martinet et al. | |
| 7,081,034 | B1 | | 7/2006 | Zoellner | |

(Continued)

*Primary Examiner* — Gloria Hale
(74) *Attorney, Agent, or Firm* — Dickinson Wright PLLC

(57) ABSTRACT

A removable insert 38 is sandwiched between the exterior flap 36 and the rear wall 32. The top edge 34 of each of the rear walls 32 extends outwardly from the center web 30 to the respective rear wings 42 next adjacent the front connection 46 of the rear wings 42 to shoulder straps 44 for exposing the removable insert 38 to the nipple of the breast. Exterior flaps 36 extend from a center web 30 and a lower extremity 28 to a flap clasp 50 for attachment to an adjacent shoulder strap 44 at a position on the shoulder strap 44 spaced a distance (d) above the front connection 46 of the rear wing 42 to the shoulder strap 44 for opening the exterior flaps 36 to expose the nipple and upper portion of the breast while the rear walls 32 remain in position under the breast.

5 Claims, 2 Drawing Sheets

(56) References Cited

U.S. PATENT DOCUMENTS

| | | | | |
|---|---|---|---|---|
| 7,244,167 | B2 | 7/2007 | Falla | |
| 7,422,508 | B2 | 9/2008 | Bentham | |
| 7,448,936 | B1 * | 11/2008 | Kemp-Dorsey | 450/36 |
| 7,871,305 | B2 | 1/2011 | Cohen | |
| 7,887,389 | B1 | 2/2011 | Lacambra | |
| 8,123,587 | B2 | 2/2012 | Liegey | |
| 8,147,291 | B2 * | 4/2012 | Hirtz | 450/36 |
| 2011/0237156 | A1 | 9/2011 | Boonen et al. | |

* cited by examiner

BRASSIERE WITH INSERT HOLDING POCKET

CROSS REFERENCE TO RELATED APPLICATION

This application claims the benefit of provisional application Ser. No. 61/601,597 filed Feb. 22, 2012.

BACKGROUND OF THE INVENTION

1. Field of the Invention

The present invention relates to a brassier assembly for supporting human female breasts with nipples on a human body defining a pair of shoulders.

2. Description of the Prior Art

A brassier assembly typically includes a pair of cups for supporting the pair of human female breasts with each cup having a lower extremity and a center web interconnecting the cups for disposition between the human female breasts. In some brassier assemblies each of the cups includes a rear wall extending upwardly in an uninterrupted and continuous sheet from the lower extremity to a top edge. The cup includes an exterior flap extending upwardly in an uninterrupted and continuous sheet from the lower extremity to an upper extremity to overlay the rear wall to form a pocket with the rear wall and for receiving and sandwiching a removable insert between the exterior flap and the rear wall. Such a typical brassier assembly may include a pair of rear wings each connected to one of the rear walls and extending from the rear walls for disposition around the back of the human body. A pair of shoulder straps are connected at respective front connections to the respective rear wings adjacent the rear walls and extend to a rear connection at the respective one of the rear wings and spaced along the rear wings from the front connection for extending over the shoulders of the human body. A flap clasp typically interconnects each of the exterior flaps and an associated one of the shoulder straps in a closed position and is releasable for selectively moving each of the exterior flaps to an open position uncovering the rear wall. Some brassier assemblies dispose the top edge of each rear wall substantially lower than the upper extremity of the exterior flap for positioning the rear wall below the nipple of the human female breast and to engage the nipple of the human female breast with the removable insert above the top edge of the rear wall while retaining the human female breast within the exterior flap. Examples of such features are illustrated in U.S. Pat. No. 6,659,841 to Raimondo and U.S. Pat. No. 7,081,034 to Zoellner.

SUMMARY OF THE INVENTION

The subject invention provides such a brassier assembly wherein the top edge of each of the rear walls extends from the center web to the rear wings next adjacent the front connection of the rear wings to the shoulder straps for exposing the removable insert to a nipple of the human female breast with each of the exterior flaps extending from the center web and the lower extremity to the flap clasp for attachment to the adjacent one of the shoulder straps at a position on the shoulder strap spaced above the front connection of the rear wing to the shoulder strap for opening the exterior flaps to expose the nipple and upper portion of the human female breast while the rear walls remain in position under the human female breast.

ADVANTAGES OF THE INVENTION

One advantage of the invention is that the underneath of the breast is supported as the rear walls remains in position under the breast when the exterior flap is open to expose the nipple and upper portion of the human female breast. Another advantage of the present invention is that the brassier assembly functions equally as well in support and comfort without the removable insert to support the human female breasts.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE ENABLING EMBODIMENTS

Figure 1:
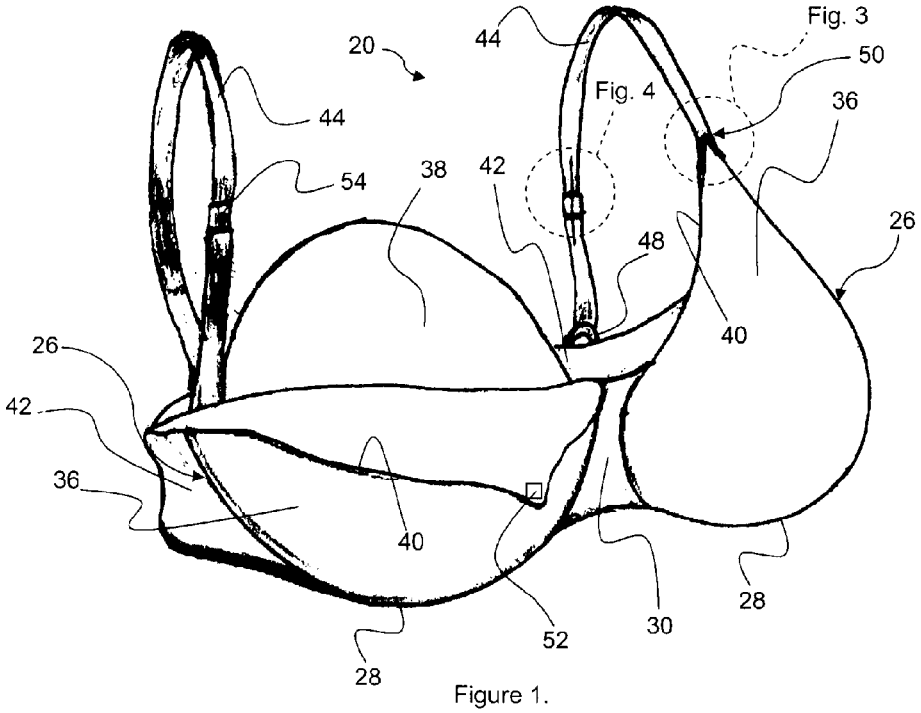
FIG. 1 is front perspective view of the brassier assembly with one exterior flap in the open position.
Figure 2:
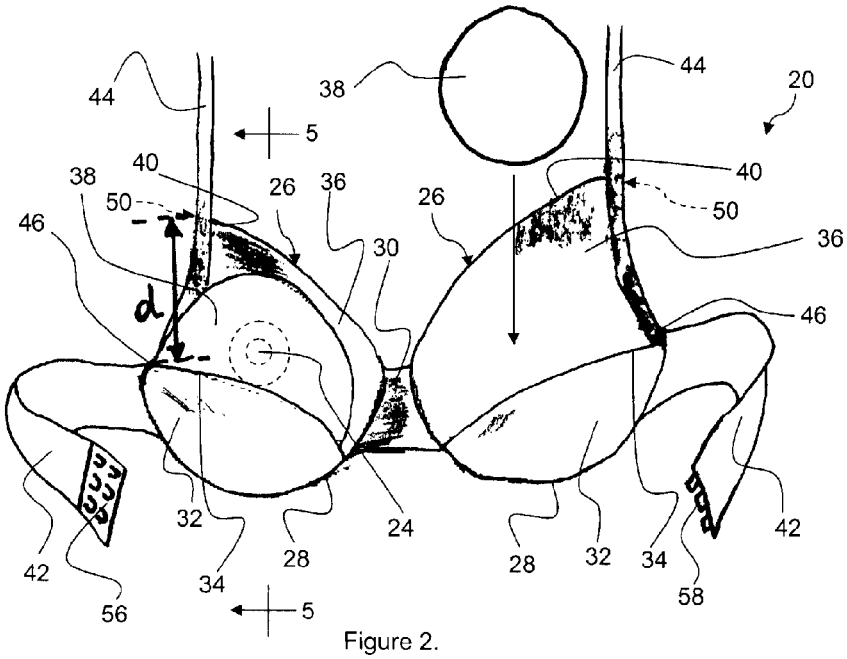
FIG. 2 is rear view of the brassier assembly.
Figure 3:
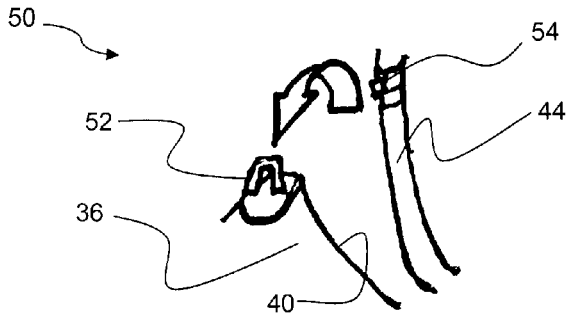
FIG. 3 is an enlarged perspective view of the flap clasp interconnecting the exterior flap and an associated one of the shoulder straps as shown in the circle from FIG. 1.
Figure 4:
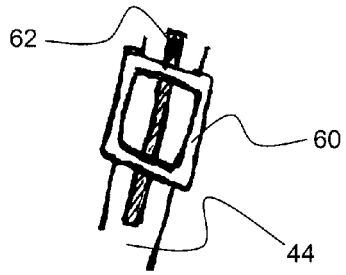
FIG. 4 is an enlarged perspective view of the lengthening clip and the rubber strip on the shoulder strap as shown in the circle of FIG. 1.

Referring to the FIGS. 1-5, wherein like numerals indicate corresponding parts throughout the several views, a brassier assembly is generally shown at 20 for supporting a pair of female breasts 22 having nipples 24 on a human body defining a pair of shoulders.

The brassier assembly 20 includes a pair of cups 26 (generally indicated) for supporting the pair of human female breasts 22 with each cup 26 having a lower extremity 28. The brassier assembly 20 includes a center web 30 interconnecting the cups 26 for disposition between the human female breasts 22. Each of the cups 26 includes a rear wall 32 that extends upwardly in an uninterrupted and continuous sheet from the lower extremity 28 to a top edge 34. In other words, the rear wall 32 is a continuous sheet without voids, i.e. openings, and provides full support underneath the human female breast 22, i.e. below the nipple 24. Each of the cups 26 includes an exterior flap 36 overlying the rear wall 32 for forming a pocket with the rear wall 32 and for receiving and sandwiching a removable insert 38 between the exterior flap 36 and the rear wall 32. Preferably, the removable insert 38 is of absorbing material for absorbing drainage of liquid from a nursing female. Alternatively, the removable insert 38 may merely shape the cup 26.

Each of the exterior flaps 36 of the brassier assembly 20 extends upwardly in an uninterrupted and continuous sheet from the lower extremity 28 to an upper extremity 40. The assembly includes a pair of rear wings 42 each connected to one of the rear walls 32. The rear wings 42 extend from the rear walls 32 for disposition around the back of the human body. A pair of shoulder straps 44 is also included with each shoulder strap 44 connected at a front connection 46 to a respective one of the rear wings 42 adjacent the rear walls 32 and is connected at a rear connection 48 to the respective one of the rear wings 42. The rear connection 48 is spaced along the rear wings 42 from the respective front connection 46 for extending over the shoulders of the human body.

A flap clasp 50, including a female clip 52 and a male hook 54, interconnects the upper extremity 40 of each of the exterior flaps 36 with the associated shoulder strap 44 in a closed position and is releasable to an open position for selectively moving each of the exterior flaps 36 to the open position uncovering the rear wall 32 and the removable insert 38, as shown in FIG. 1. The top edge 34 of each rear wall 32 is disposed substantially lower than the upper extremity 40 of the adjacent exterior flap 36 for positioning the rear wall 32 below the nipple 24 of the human female breast 22 to engage the nipple 24 of the human female breast 22 with the removable insert 38 above the top edge 34 of the rear wall 32 while retaining the human female breast 22 within the exterior flap 36.

Figure 5:
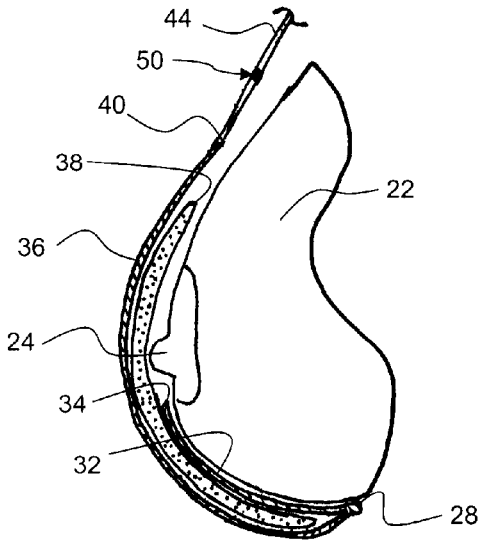
FIG. 5 is a cross-sectional view taken along line 5-5 of FIG. 2.

The brassier assembly 20 is characterized by the top edge 34 of each of the rear walls 32 extending outwardly from the center web 30 to the rear wings 42 next adjacent the front connection 46 of the rear wings 42 to the shoulder straps 44 for exposing the removable insert 38 to the nipple 24 of the human female breast 22. Each of the exterior flaps 36 extends from the center web 30 and the lower extremity 28 to the flap clasp 50 for attachment to the adjacent one of the shoulder straps 44 at a position on the shoulder strap 44 spaced a distance (d) above the front connection 46 of the rear wing 42 to the shoulder strap 44 for opening the exterior flaps 36 to expose the nipple 24 and upper portion of the human female breast 22 while the rear walls 32 remain in position under the human female breast 22. As best illustrated in FIG. 5, the removable insert 38 may be removed and the combination of each rear wall 32 and the overlying exterior flap 36 forms an excellent normal brassier assembly 20 with the rear wall 32 providing support under the breast 22 and the exterior flap 36 covering and holding the breast 22.

The brassier assembly 20 includes a wing clasp 56, 58 including a female wing clip 56 and a male wing hook 58, for removably clasping the rear wings 42 at the back of the human body, a lengthening clip 60 on each of the shoulder straps 44 for adjusting the length of the shoulder straps 44 and at least one rubber strip 62 on each of the shoulder straps 44 for preventing the lengthening clips 60 from slipping relative to the shoulders.

As will be appreciated, the rear wall 32 serves as a push-up to a human female breast 22 and may vary in thickness. Likewise, the removable insert 38 may also vary in thickness, as well as, shape and size as determined by the cup 26 size and shape. The removable insert 38 could be specific to the configuration of the brassier assembly 20.

Obviously, many modifications and variations of the present invention are possible in light of the above teachings and may be practiced otherwise than as specifically described while within the scope of the appended claims. That which is prior art in the claims precedes the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. A brassiere assembly for supporting a pair of female breasts having nipples on a human body defining a pair of shoulders comprising;

a pair of cups for supporting the pair of human female breasts, a center web interconnecting said cups for disposition between the human female breasts, each of said cups including a rear wall extending upwardly in an uninterrupted and continuous sheet from a lower extremity to a top edge, each of said cups including an exterior flap overlying said rear wall for forming a pocket with said rear wall to receive and sandwich a removable insert between said exterior flap and said rear wall, each of said exterior flaps extending upwardly in an uninterrupted and continuous sheet from said lower extremity to an upper extremity, a pair of rear wings each connected to one of said rear walls and extending from said rear walls for disposition around the back of the human body, a pair of shoulder straps each connected at a front connection to a respective one of said rear wings adjacent said rear walls and connected at a rear connection to said respective one of said rear wings spaced along said rear wings from said front connection for extending over the shoulders of the human body, a flap clasp interconnecting each of said exterior flaps and an associated one of said shoulder straps in a closed position and releasable to an open position for selectively moving each of said exterior flaps to the open position uncovering said rear wall, said top edge of each rear wall being disposed substantially lower than said upper extremity of said exterior flap for positioning said rear wall below the nipple of the human female breast and for engaging the nipple of the human female breast with the removable insert above said top edge of said rear wall thereof while retaining the human female breast within said exterior flap, and characterized by, said top edge of each of said rear walls extending from said center web to said rear wings next adjacent said front connection of said rear wings to said shoulder straps for exposing a removable insert to a nipple of the human female breast, and each of said exterior flaps extending from said center web and said lower extremity to said flap clasp for attachment to the adjacent one of said shoulder straps at a position on said shoulder strap spaced a distance above said front connection of said rear wing to said shoulder strap for opening said exterior flaps to expose a nipple and upper portion of a human female breast while said rear wall remains in position under such a human female breast.

2. An assembly as set forth in claim 1 including a removable insert of absorbing material for absorbing liquid disposed in each of said pockets and sandwiched between said exterior flap and said rear wall.

3. An assembly as set forth in claim 1 including a wing clasp for removably clasping said rear wings in the back of the human body.

4. An assembly as set forth in claim 1 including a clip on each of said shoulder straps for adjusting of said shoulder straps.

5. An assembly as set forth in claim 4 including at least one rubber strip on each of said straps for preventing said clips from slipping relative to the shoulders.

* * * * *